United States Patent [19]

Kühnert et al.

[11] Patent Number: 4,923,786

[45] Date of Patent: May 8, 1990

[54] GRANULATED COLOR PHOTOGRAPHIC DEVELOPER AND ITS PREPARATION

[75] Inventors: Peter Kühnert, Leverkusen; Peter Feyen, Mettmann, both of Fed. Rep. of Germany

[73] Assignee: Afga-Gevaert Aktiengesellschaft, Leverkusen, Fed. Rep. of Germany

[21] Appl. No.: 395,598

[22] Filed: Aug. 18, 1989

[30] Foreign Application Priority Data

Sep. 3, 1988 [DE] Fed. Rep. of Germany ..... 3830023

[51] Int. Cl.[5] ..... G03C 7/30

[52] U.S. Cl. ..... 430/450; 430/465

[58] Field of Search ..... 430/450, 465

[56] References Cited

U.S. PATENT DOCUMENTS 3,981,732 9/1976 Emoto et al. ..... 96/66.2

4,816,384 3/1989 Fruge et al. ..... 430/465

*Primary Examiner*—Paul R. Michl

*Assistant Examiner*—Janis L. Dote

[57] ABSTRACT

A granulate mixture containing at least three different granulates of solid constituents of a color photographic developer, one granulate containing the protective agent against oxidation, another granulate containing the developer substance and the third granulate containing the alkali donor, is pourable, produces no dust, rapidly dissolves in water, has unlimited durability and gives reliable, reproducible results on development.

1 Claim, No Drawings

GRANULATED COLOR PHOTOGRAPHIC DEVELOPER AND ITS PREPARATION

This invention relates to a granulated colour photographic developer and to a process for the preparation of such a developer which can be dissolved rapidly.

Colour photographic developers normally contain numerous solid components such as the developer substance proper, protective agents against oxidation, complex forming agents, sodium sulphite, alkali donors and alkali metal halides. Since these compounds are liable to react chemically with one another, they are prepared separately and mixed together only immediately before use. They may suitably be prepared as powders or as liquid concentrates. The latter have become progressively established over the years, particularly since some developers contain liquid components such as e.g. benzyl alcohol which, of course, cannot be made up into powders.

For preparing the developer ready for use, the three or four concentrates are mixed together with stirring in certain proportions, optionally with the addition of water.

Since such concentrates can only be stored for a limited length of time and the water contained in them entails high transport costs, there is a demand for solid colour photographic developer preparations which must fulfil at least the following conditions:

1. The preparation must contain all the solid components of the colour photographic developer ready for use.
2. The solid preparation must be rapidly soluble.
3. The solid preparation must not produce dust.

Although it is known from DE-A- No. 37 33 861 to prepare black-and-white developers as rapidly dissolving dry powders by first preparing a liquid photographic developer solution, removing the solvent to form a powder and packaging the powder to prevent contact with the atmosphere, freeze drying or spray drying being used for removing the solvent, this process cannot be applied to colour photographic developers, which has a completely different composition. Moreover, the times required for dissolving the powders are at least 2 to 4 minutes according to the developer, which is still too long.

It has now been found that granulated compositions containing all the solid constituents of a colour photographic developer may be obtained by grinding the components so finely that the maximum of the particle diameter distribution curve is below 10 μm, subjecting the ground particles to a process of powder agglomeration, drying the granulates in a vacuum and mixing them together and packaging them in a damp-proof form.

The present invention thus relates to a process for producing a granulated preparation of the solid constituents of a colour photographic developer, characterised in that the protective agent against oxidation, the developer substance and the alkali donor of a colour photographic developer are ground separately down to a particle size of less than 10 μm and then subjected to a process of powder agglomeration, optionally with the addition of a granulating liquid and a binder, and dried in a vacuum, and the individual granulates are then mixed together and packaged in a damp-proof form.

The resulting granulates of the solid constituents of a colour photographic developer are mechanically stable and uniform in grain size, dissolve very rapidly, have unlimited durability and are free from dust and pourable.

Reduction of the solid constituents to particles less than 10 μm in size is normally carried out by jet grinding. Powder agglomeration is preferably carried out in a fluidized bed, optionally with the addition of a granulating liquid, e.g. 200 ml of water per kg of powder, and optionally the addition of binder such as corn starch to the particles which are to be agglomerated.

The average particle diameter of the granulates should preferably be ≧150 μm, in particular from 150 to 3000 μm. If any constituents are particularly sensitive to oxygen, grinding, granulating, drying, mixing and packaging are preferably carried out under a protective gas, e.g. nitrogen.

The other components of the developer, such as water softeners, complex formers for heavy metal ions, sodium sulphite and alkali metal halide may also be worked up into granulates and added to the mixture but it is preferable for economical reasons to grind each of these additives together with one of the three essential granulate components (developer substance, antioxidizing agent or alkali donor) and then granulate the ground mixture.

The colour developer compound used may be any developer compound which is capable, in the form of its oxidation product, of reacting with colour couplers to form azomethine or indophenol dyes. Suitable colour developer compounds include aromatic compounds of the p-phenylene diamine series containing at least one primary amino group, for example, N,N-dialkyl-p-phenylenediamines such as N,N-diethyl-p-phenylenediamine, 1-(N-ethyl-N-methanesulphonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other suitable colour developers are described, for example, in J. Amer. Chem. Soc. 73, 3106 (1951) and in Modern Photographic Processing, by G. Haist, 1979, John Wiley and Sons, New York, pages 545 et seq.

The invention further relates to a granulate mixture containing at least three different granulates of solid constituents of a colour photographic developer, one granulate containing the oxidizing agent, another the developer substance and another the alkali donor.

EXAMPLE

Preparation of the granulate of the anti-oxidizing agent (Granulate A)

1 kg of crystallised hydroxyl ammonium sulphate is size reduced in an Alexander screen of mesh size 0.6 mm and then ground to an average particle diameter of <10 μm in an air jet mill.

500 g of this milled material is granulated in a commercial fluidized layer spray granulator (Strea 1-Laboratory apparatus of Aeromatic, Bubendorf/Switzerland) by spraying a total of 38 ml of water on the material within 7 minutes at room temperature, and the granulate is then dried at an air temperature of 63° C. for 8 minutes. All the particles of the granulate larger than 2000 μm are removed by screening.

The granulate is then after-dried in a vacuum at 40° C. for 90 minutes.

Preparation of the granulate of developer substance CD 4* (Granulate B)

1 kg of CD 4 is jet milled as described above. 326 g of the product are granulated in the apparatus described above. 7 ml of water are sprayed in at room temperature within 4 minutes. The granulate is then dried for 8 minutes in air which is at a temperature of at the most 60° C. Oversize particles (>2000 μm) are removed by screening. The product is after-dried in the same manner as Granulate A.

Preparation of the granulate for alkaline developer component (Granulate C and Granulate D)

* N-Ethyl-N-(2-hydroxyethyl) 3-methyl-p-phenylenediammonium sulphate

The following chemicals are mixed together:

| | Mixture C | Mixture D |
|---|---|---|
| (a) Disodium salt of 1-hydroxy-ethane-1,1-diphosphonic acid | 34 g | — |
| (b) Sodium sulphite | 39 g | 39 g |
| (c) Ethylenediamino-tetracetic acid | — | 24 g |
| (d) Potassium carbonate | 336 g | 336 g |
| (e) Sodium bicarbonate | 15 g | 15 g |
| (f) Potassium bromide | 15 g | 15 g |
| | 439 g | 429 g |

Mixtures C and D are granulated separately as follows:

1. Homogenization in a Lodige mixer
2. Air jet milling to an average particle diameter of <10 μm
3. Spray granulation in a fluidized bed layer (in the same manner as Granulates A and B) by spraying 110 (and 115, respectively) ml of water on the material within 6 minutes (or 7 minutes) followed by drying for 10 minutes at an air temperature of 70° C. and 80° C., respectively.
4. Screening to remove undersized and oversized particles (<200 μm: >2000 μm)
5. After-drying in a vacuum as described above.

Preparation of the mixed granulate ready for use:

To prepare the mixed granulate ready for use, the individual granulates A, B, C and D are mixed together in a laboratory mixer in the ratios by weight indicated below. The procedure must be carried out with exclusion of moisture.

| | |
|---|---|
| Granulate A | 2.4 g |
| Granulate B | 4.52 g |
| Granulate C | 21.95 g |
| Granulate D | 21.45 g |
| Total weight | 50.32 g |

Packaging

The mixed granulate is packaged in paper bags laminated with plastics and aluminium foil with exclusion of moisture (under a stream of very dry air) and the bags are immediately sealed.

Properties

1. The mixed granulate is pourable and produces no dust
2. Colour: colourless
3. Speed of solution: 50.32 g of the mixed granulate are introduced into 950 ml of water at about 25° C. with mild stirring. All the solid particles are dissolved within 22 seconds. The solution is yellowish in colour and clear.
4. Photographic properties Test films were developed in the colour negative film developer prepared by dissolving the mixed granulate. No sensitometric differences were found between the developed films and films developed with a conventional developer of the same type.

5. Storage stability of the developer granulate

The mixed granulate has unlimited durability if moisture is excluded at the stages of preparation and packaging.

We claim:

1. Process for the production of a granulated preparation of the solid constituents of a colour photographic developer, characterised in that the anti-oxidizing agent, the developer substance and the alkali donor of a colour photographic developer are ground down separately to a particle size of <10 μm and then subjected to a process of powder agglomeration, optionally with the addition of a granulating liquid and a binder, and dried in a vacuum, and the individual granulates are mixed together and packaged in a damp-proof package.

* * * * *